United States Patent [19]

Walsh, Jr.

[11] Patent Number: 4,779,546

[45] Date of Patent: Oct. 25, 1988

[54] FUEL LINE ORIFICE

[75] Inventor: William F. Walsh, Jr., Windsor, Conn.

[73] Assignee: Combustion Engineering, Inc., Windsor, Conn.

[21] Appl. No.: 108,616

[22] Filed: Oct. 15, 1987

Related U.S. Application Data

[63] Continuation of Ser. No. 850,456, Apr. 11, 1986, abandoned.

[51] Int. Cl.[4] ..... F23D 1/00

[52] U.S. Cl. ..... 110/265; 241/101.2; 241/119; 251/4

[58] Field of Search ..... 138/40, 46; 251/4, 8, 251/212; 406/195; 137/599, 884, 861; 110/263, 265; 241/117, 119, 121, 60, 79.1, 182, 183, 299, 300, 101.2, 57

[56] References Cited

U.S. PATENT DOCUMENTS

| | | | |
|---|---|---|---|
| 2,545,518 | 3/1951 | Hewitt | 241/39 |
| 2,885,156 | 5/1959 | Fitz et al. . | |
| 4,163,726 | 8/1979 | Wilson et al. | 251/212 X |
| 4,459,922 | 7/1984 | Chadshay . | |

*Primary Examiner*—Mark Rosenbaum

*Attorney, Agent, or Firm*—Arthur E. Fournier, Jr.

[57] ABSTRACT

An orifice assembly (6) used in a pulverized coal supply line (4) is formed of a plurality of ceramic bull nose inserts (20). Each insert is of truncated pie shape and of sufficient number around the periphery to radially lock the inserts.

4 Claims, 3 Drawing Sheets

FUEL LINE ORIFICE

This is a continuation of application Ser. No. 850,456, filed Apr. 11, 1986, now abandoned.

BACKGROUND OF INVENTION

This invention relates to coal piping for delivering pulverized coal to a steam generator, and in particular to an orifice for modifying the flow distribution between parallel lines.

Pulverized coal is conventionally entrained in air at the pulverizer and delivered through fuel pipes to a steam generator. A plurality of fuel pipes in parallel flow relationship are used to convey this coal. Maldistribution of flow through the pipes has a detrimental effect on furnace performance. Also should the flow because of this maldistribution become too low in a particular pipe, the coal will drop out of suspension and plugging of the line will occur. This low flow in any one line is normally the result of an excessive flow in other lines.

Since the pulverized coal lines must travel various routes and distances from the pulverizer to the particular location of entry into the furnace, a maldistribution of flow inherently occurs. It has been conventional practice to modify this distribution so as to obtain uniform flows by inserting orifices within the flow lines.

The pulverized coal clearly has a severe erosive effect. Orifices are initially installed to obtain the proper distribution. They erode during operation, and when decreased performance of the furnace or plugging of the coal lines is noticed, the orifices must be replaced. It has been present practice to use hardened materials such as Ni-hard or surface hardening of the orifice plate. While this increases the life of the orifice beyond that of cast iron or normal steel, it still requires frequent replacement of the orifices.

The straight replacement of a ceramic for steel cannot readily be made because of the difficulty and expense of forming a sufficiently dense annular member of ceramic material and because of the potential that exists for erratic cracking of the ceramic material due to physical bending of the pipe or thermal changes thereof during operation.

SUMMARY OF THE INVENTION

An orifice assembly is formed of ceramic wear material. A metallic support ring is formed of a hollow cylindrical body with an inwardly extending flange at one end. A multiplicity of ceramic bull nose inserts are located within the cylindrical body, sitting on the inwardly extending flange. Each of these bull nose inserts is of a truncated pie shape with a sufficient number of inserts being placed around the circumference to lock the inserts from radial movement because of their pie shape. A metal hold down ring is secured to the opposite end of the support ring to entrap the ceramic inserts. The entire orifice assembly is then secured within the coal pipe to carry out its purpose of modifying flow through the fuel pipe.

Each of the inserts is small in size and of a compact shape which may be inexpensively formed of a high density ceramic. With the preselected interface between the adjacent inserts any thermal or structural strains can be accepted by the slight movement between the inserts, thereby precluding erratic cracking of a single ceramic piece. Each of the individual inserts is sufficiently small to withstand these forces.

DESCRIPTION OF THE PREFERRED EMBODIMENT

Figure 1:
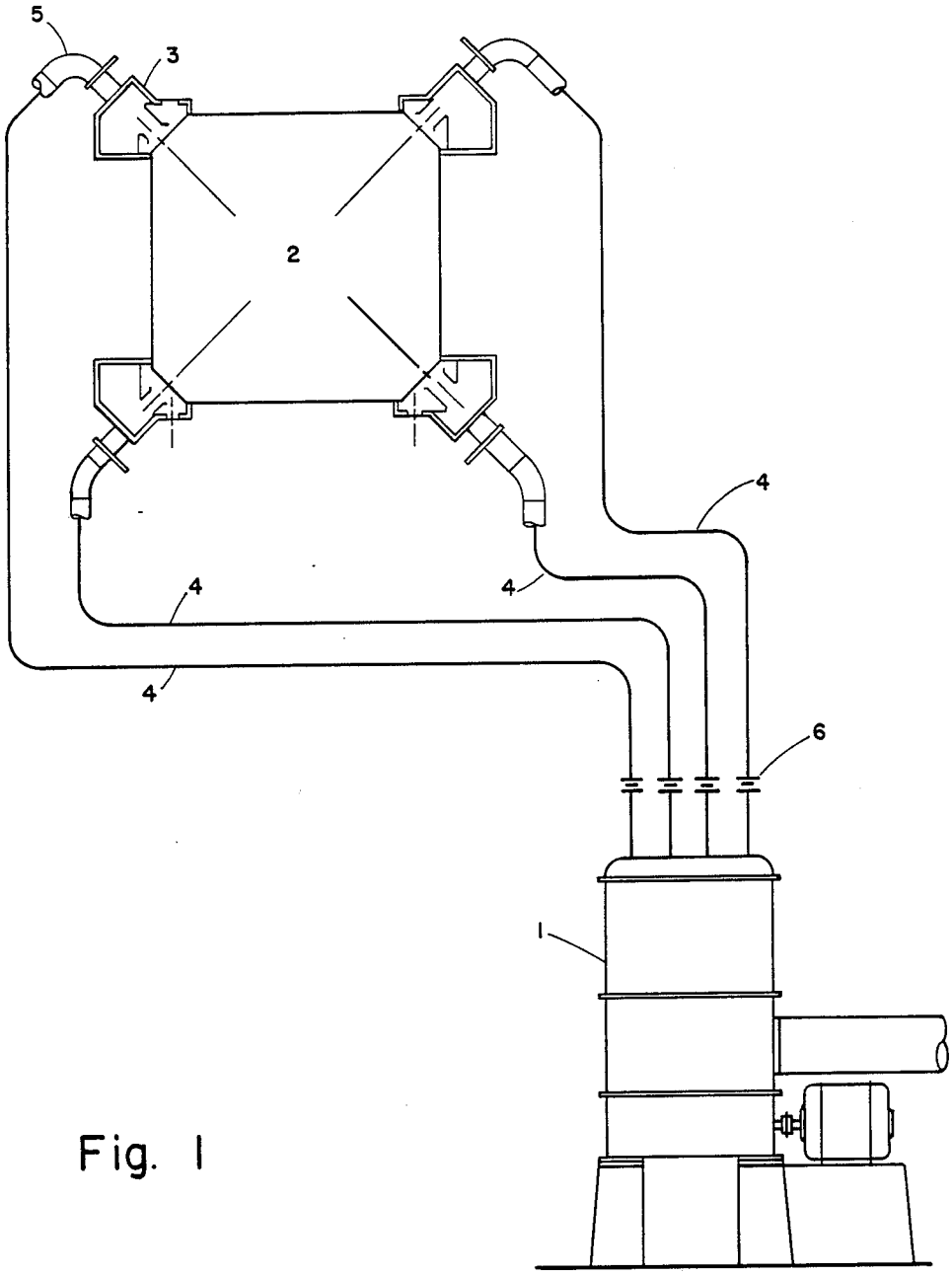
FIG. 1 is a schematic illustration showing a coal pulverizer, a steam generator, a plurality of fuel lines and the orifices of this invention located within the fuel lines.

Illustrated in FIG. 1 is a coal pulverizer (1) connected to supply pulverized coal to furnace (2). Supplemental air is supplied through windbox (3) to support combustion. Fuel lines (4) pneumatically convey the pulverized coal as an air-coal mixture from the pulverizer (1) to the furnace (2). Even in this schematic view the difference in length of these lines is apparent, which would inherently result in a variation of flow between the various lines. Orifices (6) are placed in lines (4) to modify the flow, thereby obtaining approximately equal flow through each of the lines.

Figure 2:
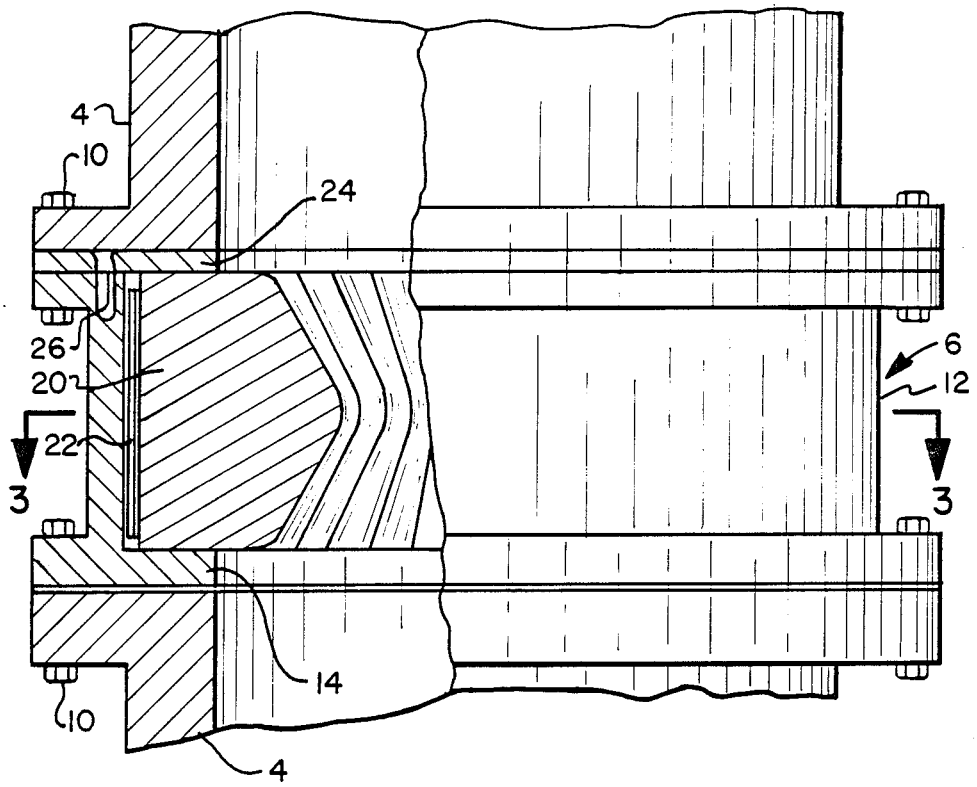
FIG. 2 is a sectional side elevation through the orifice assembly.
Figure 3:
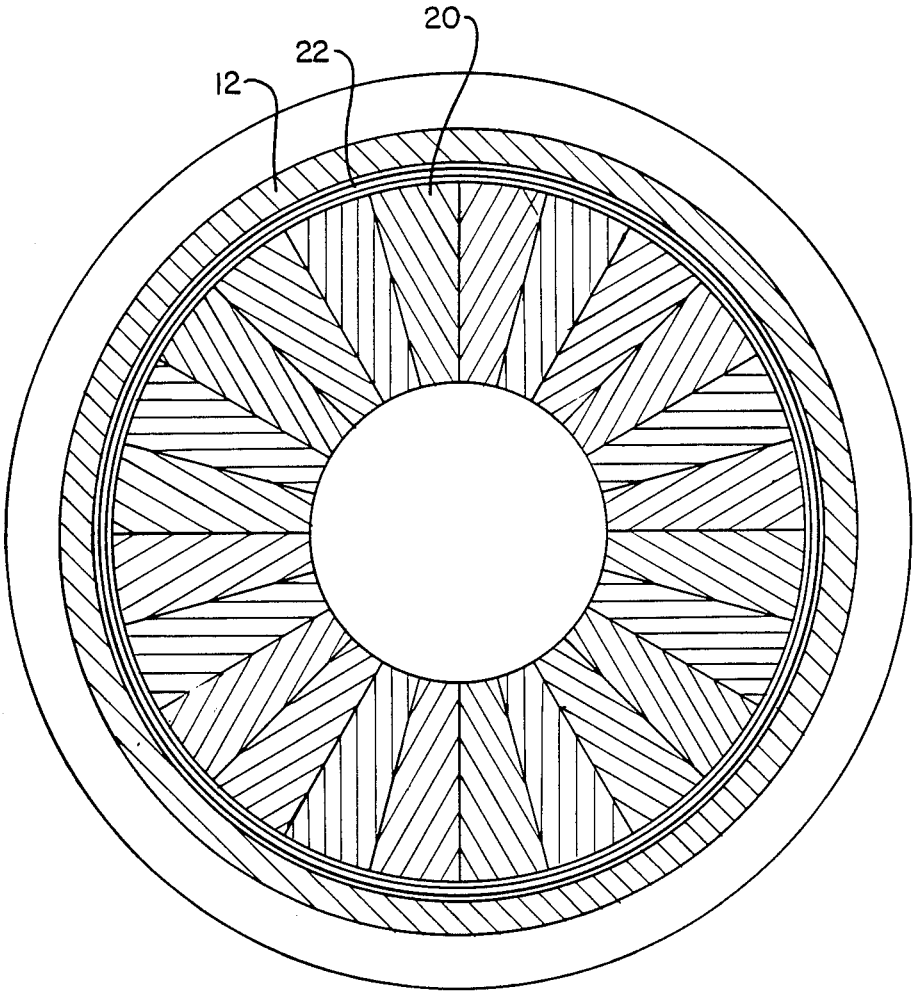
FIG. 3 is a sectional plan view through the orifice assembly.

Referring to FIG. 2, each of the orifice assemblies (6) is secured within a particular fuel line (4). A bolted and flanged connection using bolts (10) is illustrated, although any conventional means of connection would be suitable. The orifice assembly includes a support ring (12) in the form of a hollow cylindrical body, with this ring having an inwardly extending flange (14) at one end. The inside diameter of this flange (14) is preferably greater than the inside diameter of pipe (4) for the purpose of avoiding wear, and also for avoiding restriction in those lines where no orificing may be required.

A multiplicity of ceramic bull nose inserts (20) are located inside the cylindrical body (12) resting on the flange (14). Each of said inserts is of a truncated pie shape and a sufficient number is located around the periphery so that the bull nose inserts are locked in. Once a sufficient number of these inserts is placed around the periphery, they are unable to move radially inwardly because the pie shape prevents their movement by its interaction against adjacent inserts.

When the inserts are all installed, their tolerance is such that there still will be some clearance and looseness in the assembly. Shim material (22) is placed between the support body (12) and the inserts, of sufficient thickness to wedge the inserts together and to hold them firmly in place.

Thereafter hold down plate (24) is bolted to the support ring (12) using recessed bolts (26) to secure the bull nose inserts from axial movement. The entire assembly is then placed in the fuel line (4).

The ceramic inserts are of high pressure sintered alumina ceramic and preferably of a 90% alumina ceramic. A density greater than 3.5 is desired because of its high wear resistance. Such a material is difficult to form in complex shapes, but the simple shape of each bull nose insert can be readily and inexpensively formed.

Wear of an orifice plate in such an environment will often occur on only one portion of the circumference. With the plurality of inserts used here, replacement in the event of wear may be restricted to only that portion of the orifice which shows unacceptable wear.

Preheated air is used to dry and preheat the coal in the pulverizer and accordingly the fuel lines (4) operate at temperature levels up to 200° Fahrenheit. This results in thermal expansion of the coal pipes with expansion strains placed on the lines. Ceramics are notoriously brittle and any such strains could lead to fracturing of the ceramic in an erratic manner. The use of the inserts already has essentially pre-established cracks, defined by the space between adjacent inserts, and accordingly any shifting due to strain occurs at these areas rather than cracking the ceramic.

Similarly any local strains caused by the differential expansion between the ceramic and the surrounding pipe can be accepted by this slight shifting between adjacent inserts.

I claim:

1. In a system having a plurality of pipes for pneumatically conveying coal to a plurality of fuel nozzles of a furnace, the improvement of an orifice assembly installed in one of the plurality of pipes so as to establish therewithin a fixed orifice of predetermined dimensions for the purpose of modifying the flow distribution through the one of the plurality of pipes within which said orifice assembly is installed, said orifice assembly comprising:

(a.) a metallic support ring having a hollow interior, said metallic support ring including a flange formed at one end thereof so as to extend inwardly therefrom, said flange having an inside diameter of greater dimensions than the inside diameter of the one of the plurality of pipes within which said orifice assembly is installed;

(b.) orifice means consisting of a multiplicity of replaceable inserts formed of ceramic, each of said multiplicity of replaceable inserts including a base and a pair of converging sides extending outwardly from said base and terminating in a bull nose such that each of said multiplicity of replaceable inserts has a truncated pie shape, said multiplicity of replaceable inserts being supported on said flange in sufficient numbers so as to extend completely around the inner circumference of said metallic support ring such that by virtue of said truncated pie shape thereof said multiplicity of replaceable inserts are each locked relative to one another so as to prevent any substantial inward radial movement thereof and such that said bull noses of said multiplicity of replaceable inserts collectively establish a fixed orifice of predetermined dimensions within the one of the plurality of pipes in which said orifice assembly is installed;

(c.) a shim extending around the circumference of said hollow interior of said metallic support ring in interposed relation between said metallic support ring and said multiplicity of replaceable inserts, said shim being of sufficient thickness so as to eliminate any circumferential clearance that might otherwise be present between said metallic support ring and said multiplicity of replaceable inserts;

(d.) a removable metal hold down plate having an inside diameter of substantially the same dimensions as the inside diameter of the one of the plurality of pipes within which said orifice assembly is installed, said removable metal hold down plate being secured to said metallic support ring at the other end thereof so as to be operative to retain said multiplicity of replaceable inserts in supported relation on said flange of said metallic support ring and so as to be readily removable therefrom for purposes of gaining access to said multiplicity of replaceable inserts in order to effectuate the replacement of individual ones of said multiplicity of replaceable inserts when they become worn; and (e.) means for securing said removable metal hold down plate to said metallic support ring.

2. In the system as set forth in claim 1 wherein each of said multiplicity of replaceable inserts has a specific gravity greater than 3.5.

3. In the system as set forth in claim 2 wherein each of said multiplicity of replaceable inserts is formed of 90% alumina ceramic.

4. In the system as set forth in claim 2 wherein each of said multiplicity of replaceable inserts is formed of high pressure sintered alumina ceramic.

* * * * *